US009663944B1

(12) United States Patent
Lam

(10) Patent No.: US 9,663,944 B1
(45) Date of Patent: May 30, 2017

(54) WALLBOARD PANEL SUPPORT AND METHOD FOR INSTALLING A WALLBOARD PANEL

(71) Applicant: Mark W. Lam, Kingwood, TX (US)

(72) Inventor: Mark W. Lam, Kingwood, TX (US)

( * ) Notice: Subject to any disclaimer, the term of this patent is extended or adjusted under 35 U.S.C. 154(b) by 0 days.

(21) Appl. No.: 14/814,060

(22) Filed: Jul. 30, 2015

(51) Int. Cl.

| | |
|---|---|
| ***E04B 1/61*** | (2006.01) |
| ***E04B 2/02*** | (2006.01) |
| ***E04F 13/09*** | (2006.01) |
| ***E04F 13/08*** | (2006.01) |
| ***E04F 13/26*** | (2006.01) |

(52) U.S. Cl.
CPC ..... *E04B 2/02* (2013.01); *E04F 13/0866* (2013.01); *E04F 13/09* (2013.01); *E04F 13/26* (2013.01); *E04B 2002/028* (2013.01)

(58) Field of Classification Search
CPC .. E04B 2/02; E04B 2002/028; E04F 13/0866; E04F 13/09; E04F 13/26
USPC ..... 52/772
See application file for complete search history.

(56) References Cited

U.S. PATENT DOCUMENTS

| | | | | |
|---|---|---|---|---|
| 1,205,358 | A | | 11/1916 | Knapp |
| 1,250,594 | A | | 12/1917 | Knapp |
| 1,453,072 | A | | 4/1923 | Knapp |
| 1,981,239 | A | | 11/1934 | Manske |
| 2,029,549 | A | | 2/1936 | Winterich |
| 2,951,566 | A | | 9/1960 | Armenti et al. |
| 3,353,301 | A | | 11/1967 | Heilweil et al. |
| 3,368,312 | A | | 2/1968 | Shore |
| 3,481,090 | A | | 12/1969 | Lizee |
| 3,956,861 | A | | 5/1976 | Rasmussen |
| 3,994,105 | A | | 11/1976 | Jamison et al. |
| 4,068,432 | A | | 1/1978 | Davis |
| 4,430,832 | A | | 2/1984 | Kaiser et al. |
| 4,513,557 | A | * | 4/1985 | Wendt ..... E04B 2/825 52/242 |
| 4,622,791 | A | | 11/1986 | Cook et al. |
| D324,575 | S | * | 3/1992 | Davis ..... D25/119 |
| 5,279,088 | A | | 1/1994 | Heydon |

(Continued)

FOREIGN PATENT DOCUMENTS

| | | | |
|---|---|---|---|
| EP | 0933485 | A1 | 8/1999 |
| GB | 2307490 | A | 5/1997 |
| JP | 2013028955 | A | 2/2013 |

OTHER PUBLICATIONS www.thrasherbasement.com ; "The WaterGuard Below-Floor French Drain System"; Mar. 24, 2015; Thrasher Basement Systems, Inc.

(Continued)

*Primary Examiner* — Joshua J Michener
*Assistant Examiner* — Keith Minter
(74) *Attorney, Agent, or Firm* — Greenberg Traurig, LLP

(57) ABSTRACT

A wallboard panel support may include a base support member having two upwardly extending sidewalls which receive the lower end of the wallboard panel and space the lower end of the wallboard panel above a floor of a building. A method for installing a wallboard panel in a building may include attaching a wallboard panel support to the lower end of a wallboard panel, moving the wallboard panel attached to the wallboard panel support to a location in a building adjacent a stud, placing the wallboard panel against the stud, and securing the wallboard panel to the stud.

8 Claims, 2 Drawing Sheets

(56) References Cited

U.S. PATENT DOCUMENTS

| | | | | |
|---|---|---|---|---|
| 5,388,813 | A * | 2/1995 | Arsenault | B25B 5/101 269/155 |
| D405,194 | S * | 2/1999 | Kenkel | D25/119 |
| D505,909 | S * | 6/2005 | Erskine | D12/317 |
| 8,065,839 | B2 | 11/2011 | Conlin | |
| 8,607,525 | B2 | 12/2013 | Trotter | |
| 2005/0005576 | A1 | 1/2005 | Ruston | |
| 2007/0163191 | A1 | 7/2007 | Berry | |
| 2008/0008433 | A1 | 1/2008 | Parker | |
| 2008/0307747 | A1 | 12/2008 | Douglas | |
| 2009/0064631 | A1 | 3/2009 | Frezza | |
| 2012/0005967 | A1 | 1/2012 | Hourihan | |
| 2012/0317902 | A1 | 12/2012 | Kapteyn | |
| 2013/0255171 | A1 | 10/2013 | Rutherford | |
| 2014/0352232 | A1 | 12/2014 | Malakauskas et al. | |

OTHER PUBLICATIONS www.thisisdrywall.com ; "Healthy, Safe, Moisture & Mold Free Basement Living Space"; Mar. 18, 2013.

* cited by examiner

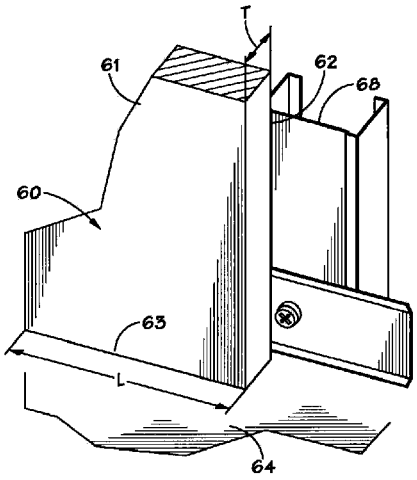
FIG. 1
(Prior Art)
FIG. 5
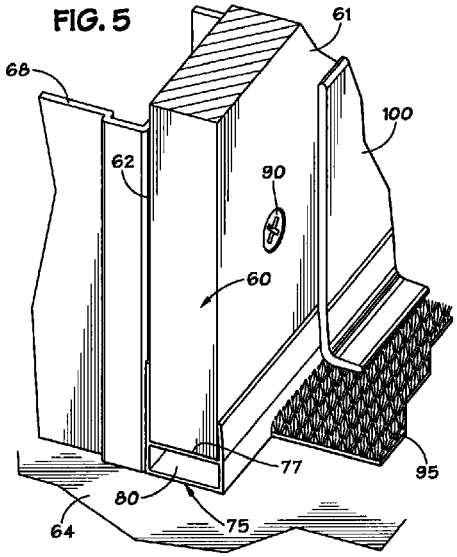

WALLBOARD PANEL SUPPORT AND METHOD FOR INSTALLING A WALLBOARD PANEL

BACKGROUND OF THE INVENTION

1. Field of the Disclosure

This disclosure relates generally to the field of construction of walls in commercial and/or residential buildings.

2. Description of the Related Art

Walls in commercial and/or residential buildings are typically constructed of wallboard panels which are secured to a supporting framework which typically includes a plurality of studs, or upright supports, to which the wallboard panels are secured by fasteners, such as screws and/or nails. The studs may be made of metal or wood 2"×4" lengths of lumber, as are known in the art. The wallboard panels may be gypsum wallboard panels, such as those sold under the trademark SHEETROCK®, by United States Gypsum Company, among other brands. Such wallboard panels typically are manufactured with a paper face on each side of the wallboard panel.

BRIEF SUMMARY

The following presents a simplified summary of the disclosed subject matter in order to provide a basic understanding of some aspects of the subject matter disclosed herein. This summary is not an exhaustive overview of the technology disclosed herein. It is not intended to identify key or critical elements of the invention or to delineate the scope of the invention. Its sole purpose is to present some concepts in a simplified form as a prelude to the more detailed description that is discussed later.

In one illustrative embodiment, a wallboard panel support for use in installing a wallboard panel in a spaced relationship from a floor surface of a building, the wallboard panel having a thickness dimension and a length dimension may include: an elongate base support member having a substantially rectangular cross-sectional configuration with a lower horizontal wall surface, an upper horizontal wall surface, and at least two vertical wall surfaces, the at least two vertical wall surfaces being disposed in a spaced relationship from each other, and the at least two vertical wall surfaces being disposed between the lower and upper horizontal wall surfaces; a first sidewall extending upwardly from the upper horizontal wall surface of the base support member, the first sidewall being disposed substantially perpendicular to the upper horizontal wall surface of the base support member, and the first sidewall having a height; a second sidewall extending upwardly from the upper horizontal wall surface of the base support member, the second sidewall sloping toward the first sidewall and being disposed at an angle with respect to the upper horizontal wall surface of the base support member, the angle being within a range of from 80° to less than 90°, the second sidewall having a height, the second sidewall being disposed in a spaced relationship with the first sidewall and spaced a distance from the first sidewall that is approximately the same as the thickness dimension of the wallboard panel; the height of the first sidewall being greater than the height of the second sidewall whereby the wallboard panel may be received between the first and second sidewalls and abut against the upper horizontal wall surface of the elongate base support member.

The first and second sidewalls may be formed integral with the elongate base support member and may be formed of a plastic material, such as polyvinyl chloride. The angle of the second sidewall may be within a range of from 85° to less than 90°. The elongate base support member may have a height and the height of the elongate base support member may be within a range of from ½ to 2½ inches.

In another illustrative embodiment, a method for installing a wallboard panel in a building having a floor surface and at least one stud, the wallboard panel having a front wall surface, a back wall surface, a thickness dimension, a length dimension, and a lower end, may include: providing at least one wallboard panel support having a base support member having a lower horizontal wall surface and an upper horizontal wall surface, the base support member having a height, a first sidewall extending upwardly from the upper horizontal wall surface of the base support member, the first sidewall being disposed substantially perpendicular to the upper horizontal wall surface of the base support member, the first sidewall having a height, a second sidewall having a height and extending upwardly from the upper horizontal wall surface of the base support member, the second sidewall being disposed in a spaced relationship with the first sidewall and spaced a distance from the first sidewall that is approximately the same as the thickness dimension of the wallboard panel, and the height of the first sidewall is greater than the height of the second sidewall; attaching the at least one wallboard panel support to the lower end of the wallboard panel by inserting the lower end of the wallboard panel into the at least one wallboard panel support, with the lower end of the wallboard panel abutting the upper horizontal wall surface of the base support member, with the back wall surface of the wallboard panel contacting the first sidewall of the base support member, and with the front wall surface of the wallboard panel contacting the second sidewall of the base support member; moving the wallboard panel attached to the at least one wallboard panel support to a location in the building adjacent the at least one stud; placing the wallboard panel attached to the at least one wallboard panel support against the at least one stud with the back wall surface of the wallboard panel and the first sidewall contacting the at least one stud; securing the wallboard panel to the at least one stud, whereby the wallboard panel is disposed above the floor surface of the building by a distance which is at least the height of the base support member. The wallboard panel may be secured to the at least one stud by putting at least one fastener through the wallboard panel into engagement with the at least one stud. The at least one wallboard panel support may be an elongate base support member having a length, and the length of the elongate base support member may be at least the same at the length dimension of the wallboard panel.

The second sidewall of the base support may slope toward the first sidewall and be disposed at an angle with respect to the upper horizontal wall surface of the base support member with the angle being within a range of from 80° to less than 90°. The lower end of the wallboard panel may be inserted into the at least one wallboard panel support by flexing the first sidewall outwardly away from the second sidewall, by the back wall surface of the wallboard panel contacting the first sidewall to permit the lower end the wallboard panel to be inserted into the at least wallboard panel support.

BRIEF DESCRIPTION OF THE DRAWING

The present wallboard panel support and method for installing a wallboard panel may be understood by reference to the following description taken in conjunction with the accompanying drawing, in which:

FIG. 1 is a perspective view of a wallboard panel being used to construct a wall using prior art techniques;

FIG. 5 is a perspective view of an installed wallboard panel in a spaced relationship from a floor surface of a building with the present wallboard panel support.

Figure 2:
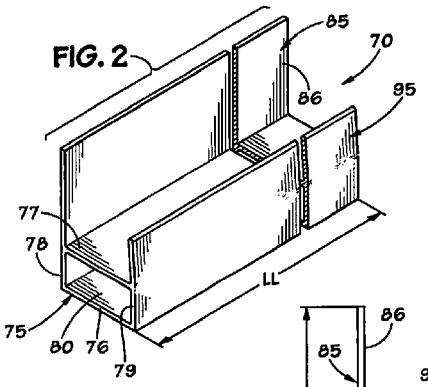
FIG. 2 is a perspective view of a portion of an embodiment of the present wallboard panel support.

While certain embodiments of the present wallboard panel support and method for installing a wallboard panel in a building will be described in connection with the present illustrative embodiments shown herein, it will be understood that it is not intended to limit the invention to those embodiments. On the contrary, it is intended to cover all alternatives, modifications, and equivalents, as may be included within the spirit and scope of the invention as defined by the appended claims. In the drawing figures, which are not to scale, the same reference numerals are used throughout the description and in the drawing figures for components and elements having the same structure, and primed reference numerals are used for components and elements having a similar function and construction to those components and elements having the same unprimed reference numerals.

DETAILED DESCRIPTION OF THE SPECIFIC EMBODIMENTS

It should be understood that, although an illustrative implementation of one or more embodiments are provided below, the various specific embodiments may be implemented using any number of techniques known by persons of ordinary skill in the art. The disclosure should in no way be limited to the illustrative embodiments, drawings, and/or techniques illustrated below, including the exemplary designs and implementations illustrated and described herein. Furthermore, the disclosure may be modified within the scope of the appended claims along with their full scope of equivalents.

With reference to FIG. 1, a conventional wallboard panel 60 made from gypsum, or a similar material, is shown adjacent a conventional stud, or upright support 68, to which the wallboard panel 60 is secured in a conventional manner as by fasteners, such as screws (not shown). Stud 68 is a stud formed of metal, as are typically used in commercial construction. The wallboard panel 60 has a front wall surface 61 and a back wall surface 62 which are typically paper facings with the gypsum material disposed between the paper facings of the front wall surface and the back wall surfaces 61, 62. The wallboard panel 60 has a thickness dimension T and a length dimension L. Conventional wallboard panel thickness dimensions are ¼", ½", ⅝", and 1". The lower end 63 of wallboard panel 60 rests upon a floor surface 64 of the building (not shown), and floor surface 64 is typically a concrete floor surface in the case of a commercial building. If water contacts the lower end 63 of wallboard panel 60, the paper facing on the front and/or back wall surfaces 61, 62 may absorb the water and moisture can be wicked by the paper facing on the front wall surface 61 upwardly into the wallboard panel 60. Such moisture can promote the growth of mold. Sometimes contractors will try to space the lower end 63 of a wallboard panel 60 from the floor surface 64, as by putting shims (not shown) formed of scraps of wallboard panel 60 to space the lower end 63 of wallboard panel 60 from the floor surface 64. After the wallboard panel 60 has been secured to a stud 68, such contractors may try to remove the shims from beneath the lower end 63 of the wallboard panel 60. In some instances, a contractor may also install a wallboard panel 60 as shown in FIG. 1, and after the wallboard panel 60 has been secured to stud 68, the contractor will come in and cut, or saw, or use a router to form a gap between the floor surface 64 and the lower end 63 of wallboard panel 60.

Figure 3:
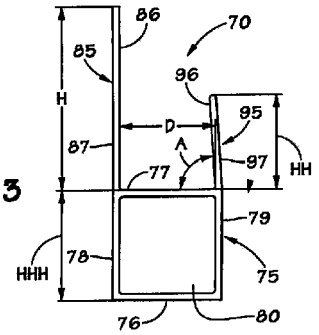
FIG. 3 is an end view of an embodiment of the present wallboard panel support, similar to that of FIG. 2.

With reference to FIGS. 2 and 3, the present wallboard panel support 70 will be described. Wallboard panel support generally includes an elongate base support member 75, a first sidewall 85, and a second sidewall 95. As seen in FIGS. 2 and 3, the elongate base support member 75 has a substantially rectangular cross-sectional configuration, a rectangular cross-sectional configuration shown in FIG. 2 and a substantially square cross-sectional configuration shown in FIG. 3. Base support member 75 has a lower horizontal wall surface 76, an upper horizontal wall surface 77, and at least two vertical wall surfaces 78, 79 disposed in a spaced relationship from each other and the at least two vertical wall surfaces 78, 79 are disposed between the lower and upper horizontal wall surfaces 76, 77. If desired, additional vertical wall surfaces may be provided, or the volume of space 80 between the at least two vertical wall surfaces 78, 79, could be completely filled with additional vertical wall surfaces to the point that the space 80 between vertical wall surfaces 78, 79 would be a solid structure. Alternatively, the volume of space 80 between the wall surfaces 76, 77, 78, 79 could have a circular or oval-shaped cross-sectional configuration rather than the rectangular or square cross-sectional configurations shown in FIGS. 2 and 3.

Still with reference to FIGS. 2 and 3, the first sidewall 85 of wallboard panel support 70 is shown to be extending upwardly from the upper horizontal wall surface 77 of the base support member 75. First sidewall 85 preferably has substantially flat, planar inner and outer wall surfaces 86, 87. Preferably the first sidewall 85 is disposed substantially perpendicular to the upper horizontal wall surface 77 of the base support member 75. The first sidewall 85 has a height, H, as shown in FIG. 3. The second sidewall 95 of wallboard panel support 70 also extends upwardly from the upper horizontal wall surface 77 of the base support member 75. Second sidewall 95 preferably has substantially flat, planar inner and outer wall surfaces 96, 97. The second sidewall 95 may also be disposed substantially perpendicular to the upper horizontal wall surface 77 of the base support member 75; however, preferably the second sidewall 95 slopes, or is canted, toward the first sidewall 85 as shown in FIG. 3. The first sidewall 95 may be disposed at an angle A, as shown in FIG. 3, with respect to the upper horizontal wall surface 77 of the base support member 75. The angle may be within a range of from 80° to less than 90°. Preferably, the angle of the second sidewall 95 is within a range of from 85° to less than 90°. The second sidewall 95 also has a height, HH, as shown in FIG. 3. The second sidewall 95 is disposed in a spaced relationship with the first sidewall 85 at a distance, D, from the first sidewall 85, that is approximately the same as the thickness dimension T of the wallboard panel 60 (FIG. 1).

The base support member 75 has a height, HHH, and the height HHH of the base support member 75 is within a range from ½ inch to 2½ inches, dependent upon how high it is desired to space the lower end 63 of a wallboard panel 60 from the floor surface 64 (FIG. 1). Preferably, the height HHH of the base support member 75 is within a range from ½ inch to 2 inches. Preferably, the distance D between the first and second sidewalls 85, 95 is about 1.32 inch greater than the thickness dimension T of the wallboard panel 60 to assist in the insertion of the lower end 63 of wallboard panel 60 into wallboard panel support 70. As seen in FIG. 2, the base support member may have a length LL and the length LL of the base support member 75 is at least the same as the length dimension L of the wallboard panel 60 (FIG. 1). Typically, wallboard panels come in 4-foot lengths and the wallboard panel support 70 may also be manufactured in 4-foot lengths to correspond to the size of the wallboard panel 60. If the present wallboard panel support 70 is used with a shorter wallboard panel 60, wallboard panel support 70 may be easily cut, as will be hereinafter described, to accommodate a wallboard panel 60 having a shorter length dimension L.

Figure 4:
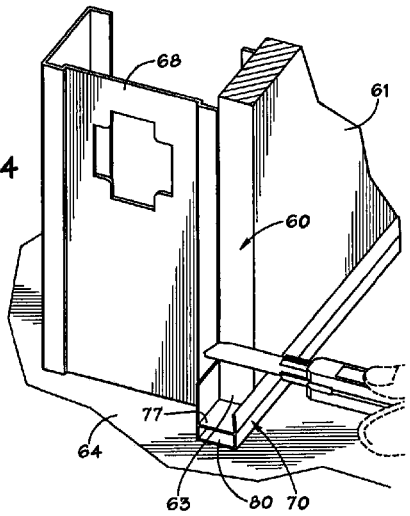
FIG. 4 is a perspective view of a wallboard panel being installed in a building with the present wallboard panel support.

As shown in FIGS. 2 and 3, the height H of the first sidewall 85 is greater than the height HH of the second sidewall 95. When the wallboard panel 60 is received within the first and second sidewalls 85, 95, as shown in FIGS. 4 and 5, the lower end 63 of wallboard panel 60 abuts against the upper horizontal wall surface 77 of the base support member 75. The wallboard panel support 70 may be formed of any suitable material having the requisite strength and durability requirements to be able to receive and support a wallboard panel 60. Wallboard panel support 70 may be formed of metal or any suitable plastic material, polyvinyl chloride being preferred. If desired, the base support member 75, first sidewall 85 and second sidewall 95 could be formed as separate components and attached in a conventional manner such as by heat sealing, glue, or an epoxy material; however, preferably the first and second sidewalls 85, 95 are formed integral with the base support member 75, such as by extruding them as an integral unit from a polyvinyl chloride plastic material.

With reference to FIGS. 4 and 5, the present method for installing a wallboard panel 60 in a building having a floor surface 64 will be described. As shown in FIGS. 4 and 5, a wallboard panel 60 is being installed in a commercial building, wherein metal studs 68 are utilized and the wallboard panel 60 is being installed upon a concrete floor surface 64. It should be noted that the present wallboard panel support 70 and the present method for installing a wallboard panel 60 may also be used in a residential building, wherein typically the first floor of a residence does have a concrete floor surface 64, and instead of metal studs 68, studs 68 would be formed of 2"×4" lumber. If the residence has a second floor, typically the floor surface 64 is a wooden floor surface (not shown). The present wallboard panel support 70 and method for installing a wallboard panel 60 may be used in both types of buildings, with both types of floor surfaces 64.

Typically a plurality of wallboard panels 60 arrive at a construction site upon a pallet (not shown), with the plurality of panels being disposed horizontally on top of each other upon the pallet. In accordance with the present method, a wallboard panel 60 may be installed by providing at least one wallboard panel support 70 as previously described, and the at least one wallboard panel support 70 is attached to the lower end 63 of the wallboard panel 60 by inserting the lower end 63 of the wallboard panel 60 into the at least wallboard panel support 70. As shown in FIGS. 4 and 5, the lower end 63 of the wallboard panel 60 abuts the upper horizontal wall surface 77 of the base support member 75, with the back wall surface 62 of the wallboard panel 60 contacting the first sidewall 85 of the base support member 70, and the front wall surface 61 of the wallboard panel 60 contacting the second sidewall 95 of the base support member 75. The at least one wallboard panel support 70 may be attached to the at least one wallboard panel 60 while the wallboard panel 60 is laying in a stack upon a pallet (not shown) at the construction site. Preferably the wallboard panel 60 on the top of the stack of wallboard panels could be slightly moved to expose the lower end 63 of the wallboard panel 60, so as to give a worker access to the lower end 63 of the wallboard panel 60 to permit the wallboard panel support 70 to be attached to a wallboard panel 60. Alternatively, if desired, the wallboard panel support 70 could be attached to the wallboard panels 60 at the manufacturing plant where the wallboard panels 60 are made, and the wallboard panels 60 could be shipped to the building in which it is desired to install a wallboard panel 60.

If the wallboard panel support 70 is attached to a wallboard panel 60 at the construction site, the wallboard panel support 70 could be attached to a wallboard panel 60 in the following manner. The lower end 63 of a wallboard panel 60 may be inserted into the wallboard panel support 70 by flexing the first sidewall 85 outwardly away from the second sidewall 95, as by contacting the inner wall surface 86 of first sidewall 85 with the back wall surface 62 of the lower end 63 of wallboard panel 60 to force the first sidewall 85 to flex, or move outwardly. This flexing permits the lower end 63 of the wallboard panel 60 to be inserted into the wallboard panel support 70 with the lower end 63 of the wallboard panel 60 abutting the upper horizontal wall surface 77 of the base support member 75 of wallboard panel support 70. Alternatively, the lower end 63 of wallboard panel 60 may be inserted into wallboard panel support 70 by flexing the second sidewall 95 outwardly away from the first sidewall 85, as by contacting the inner wall surface 96 of the second sidewall 95 with the front wall surface 61 of wallboard panel 60, to flex the second sidewall 95 to permit wallboard panel 60 to be inserted into the wallboard panel support 70.

The wallboard panel 60 attached to the at least one wallboard panel support 70 is then moved to a location in the building adjacent at least one stud 68 to which the wallboard panel 60 will be secured. The wallboard panel 60 attached to the at least one wallboard panel support 70 is placed against the at least one stud 68 with the back wall surface 62 of the wallboard panel 60 and the first sidewall 85 contacting the at least one stud 68. Thereafter, the wallboard panel 60 is secured to the at least one stud 68 whereby the wallboard panel 60 is disposed above the floor surface 64 by a distance which is at least the height HHH of the base support member 75 as shown in FIG. 5. The wallboard panel 60 may be secured to the at least one stud 68 by putting at least one fastener 90 through the wallboard panel 60 into engagement with the at least one stud 68. Typically in connection with commercial construction, fastener 90 would be a screw. In residential construction, fastener 90 could also be a screw, as well as sometimes conventional nails are utilized.

It should be noted that if desired, instead of utilizing a single elongate base support member 75 having a length LL corresponding to the length L of the panel 60, as shown in FIGS. 2-5, to support wallboard panel 60 in its desired spaced relationship from the floor surface 64, a plurality of wallboard panel supports 70, each having a length LL less than the total length L of the wallboard panel 60. Thus if desired, a plurality of individual wallboard panel supports 70 could be spaced along the lower end 63 of a wallboard panel 60 in order to provide the desired spaced relationship of wallboard panel 60 from the floor surface 64. As seen in FIG. 4, if the lengths LL of the wallboard panel support 70 is greater than the length L of the wallboard panel 60, the excess material may be readily removed by simply cutting the excess portion of the wallboard panel support 70.

As shown in FIG. 5, after wallboard panel 60 has been secured to the studs 68, if desired, carpeting 95 may be laid upon the floor surface 64. Alternatively, a wood floor could be installed upon floor surface 64. A length of a conventional rubber base member 100 may be secured to the front wall surface 61 of the wallboard panel 60 to cover the lower end 63 of the wallboard panel 60 and the wallboard panel support member 75 as shown in FIG. 5. For illustrative purposes, the rubber base member 100 is shown not extending to the end of the wallboard panel 60, so that the location of fastener 90 extending into panel 60 may be shown. If water is disposed adjacent a wallboard panel 60 during the construction phase as shown in FIG. 4, or after a floor covering, such as carpeting 95 has been placed upon floor surface 64, such water would be prevented by the wallboard panel support 70 from contacting the wallboard panel 60.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. When numerical ranges or limitations are expressly stated, such express ranges or limitations may be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). The use of the term "about" means ±10% of the subsequent number, unless otherwise stated.

Use of the term "optionally" with respect to any element of a claim means that the element is required, or alternatively, the element is not required, both alternatives being within the scope of the claim. Use of broader terms such as comprises, includes, and having may be understood to provide support for narrower terms such as consisting of, consisting essentially of, and comprised substantially of. Accordingly, the scope of protection is not limited by the description set out above, but is defined by the claims that follow, that scope including all equivalents of the subject matter of the claims. Each and every claim is incorporated as further disclosure into the specification and the claims are embodiment(s) of the present disclosure.

While several embodiments have been provided in the present disclosure, it may be understood that the disclosed embodiments might be embodied in many other specific forms without departing from the spirit or scope of the present disclosure and the appended claims. The present examples are to be considered as illustrative and not restrictive, and the intention is not to be limited to the details given herein. For example, the various elements or components may be combined or integrated in another system or certain features may be omitted, or not implemented.

In addition, the various embodiments described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and may be made without departing from the spirit and scope disclosed herein.

I claim:

1. A method for installing a wallboard panel in a building having a floor surface and at least one stud, the wallboard panel having a front wall surface, a back wall surface, a thickness dimension, a length dimension, and a lower end, comprising:

providing at least one wallboard panel support having a base support member having a lower horizontal wall surface and an upper horizontal wall surface, the base support member having a height, a first sidewall extending upwardly from the upper horizontal wall surface of the base support member, the first sidewall being disposed substantially perpendicular to the upper horizontal wall surface of the base support member, the first sidewall having a height, a second sidewall having a height and extending upwardly from the upper horizontal wall surface of the base support member, the second sidewall being disposed in a spaced relationship with the first sidewall and spaced a distance from the first sidewall that is approximately the same as the thickness dimension of the wallboard panel, and the height of the first sidewall is greater than the height of the second sidewall;

attaching the at least one wallboard panel support to the lower end of the wallboard panel by inserting the lower end of the wallboard panel into the at least one wallboard panel support, with the lower end of the wallboard panel abutting the upper horizontal wall surface of the base support member, with the back wall surface of the wallboard panel contacting the first sidewall of the base support member, and with the front wall surface of the wallboard panel contacting the second sidewall of the base support member;

moving the wallboard panel attached to the at least one wallboard panel support to a location in the building adjacent the at least one stud;

placing the wallboard panel attached to the at least one wallboard panel support against the at least one stud with the back wall surface of the wallboard panel and the first sidewall contacting the at least one stud;

securing the wallboard panel to the at least one stud, whereby the wallboard panel is disposed above the floor surface of the building by a distance which is at least the height of the base support member.

2. The method of claim 1, wherein the wallboard panel is secured to the at least one stud by putting at least one fastener through the wallboard panel into engagement with the at least one stud.

3. The method of claim 1, wherein the at least one wallboard panel support is an elongate base support member having a length, and the length of the elongate base support member is at least the same as the length dimension of the wallboard panel.

4. The method of claim 1, wherein the second sidewall of the base support member slopes toward the first sidewall and is disposed at an angle with respect to the upper horizontal wall surface of the base support member, the angle being within a range of from 80° to less than 900, and the lower end of the wallboard panel is inserted into the at least one wallboard panel support by flexing the first sidewall outwardly away from the second sidewall, by the back wall surface of the wallboard panel contacting the first sidewall to permit the lower end of the wallboard panel to be inserted into the at least one wallboard panel support.

5. The method of claim 4, wherein the angle of the second sidewall is within a range of from 85° to less than 90°.

6. The method of claim 1, wherein the second sidewall of the base support member slopes toward the first sidewall and is disposed at an angle with respect to the upper horizontal wall surface of the base support member, the angle being within a range of from 80° to less than 90° and the lower end of the wallboard panel is inserted into the at least one wallboard panel support by flexing the second sidewall outwardly away from the first sidewall, by the front wall surface of the wallboard panel contacting the second sidewall to permit the lower end of the wallboard panel to be inserted into the at least one wallboard panel support.

7. The method of claim 6, wherein the angle of the second sidewall is within a range of from 85' to less than 90°.

8. The method of claim 1, including securing a length of rubber base member to the front wall surface of the wallboard panel member to cover the lower end of the wallboard panel and the at least one wallboard panel support member.

* * * * *